US010577827B2

(12) United States Patent
Kurtin et al.

(10) Patent No.: US 10,577,827 B2
(45) Date of Patent: Mar. 3, 2020

(54) MODULAR BARRIER SYSTEM WITH PANELS HAVING ATTACHED LINKS

(71) Applicant: Lane Research, Sherman Oaks, CA (US)

(72) Inventors: Stephen Kurtin, Sherman Oaks, CA (US); Scott Winslow, Chatsworth, CA (US); Brian Packard, North Andover, MA (US)

(73) Assignee: Lane Research, Sherman Oaks, CA (US)

( * ) Notice: Subject to any disclaimer, the term of this patent is extended or adjusted under 35 U.S.C. 154(b) by 0 days.

(21) Appl. No.: 16/352,702

(22) Filed: Mar. 13, 2019

(65) Prior Publication Data

US 2019/0301197 A1 Oct. 3, 2019

Related U.S. Application Data

(60) Provisional application No. 62/651,145, filed on Mar. 31, 2018, provisional application No. 62/656,854, filed on Apr. 12, 2018.

(51) Int. Cl.

| | |
|---|---|
| ***E04H 17/18*** | (2006.01) |
| ***A63C 19/10*** | (2006.01) |
| *A63H 19/10* | (2006.01) |

(52) U.S. Cl.

CPC ..... *E04H 17/18* (2013.01); *A63C 19/10* (2013.01)

(58) Field of Classification Search

CPC ..... A63C 19/10; E01F 15/08; E01F 15/081; E01F 15/083; E01F 15/085; E01F 15/086; E01F 15/088; E01F 15/10; E04H 17/16; E04H 17/165; E04H 17/166; E04H 17/18; Y10T 403/32368

USPC ..... 256/19, 24, 258, 31, 73; 403/97

See application file for complete search history.

(56) References Cited

U.S. PATENT DOCUMENTS

| | | | |
|---|---|---|---|
| 4,068,968 | A | 1/1978 | Gagle et al. |
| 5,611,641 | A | 3/1997 | Christensen |
| 5,669,227 | A | 9/1997 | Morris |
| 5,820,470 | A | 10/1998 | Saunders |
| 5,882,140 | A | 3/1999 | Yodock, Jr. et al. |

(Continued)

FOREIGN PATENT DOCUMENTS

FR 2439269 A1 * 5/1980 ..... A63C 19/10

OTHER PUBLICATIONS

"NiceRink", "http://www.nicerink.com", downloaded from the Internet on Jan. 9, 2017.

(Continued)

*Primary Examiner* — Josh Skroupa
(74) *Attorney, Agent, or Firm* — Chen Yoshimura LLP

(57) ABSTRACT

A modular barrier system enables demountable outdoor rinks—typically for ice hockey, or ice skating, or street hockey. A rink includes multiple panels, each having a factory-attached link. These panels are linearly disposed, adjacent to one another, to form a piecewise continuous boundary wall enclosing a desired area. Attaching one link to the next, typically via insertion of a thumbscrew, connects the panels into a robust assembly. Both straight and curved panels are provided, thereby enabling a rink with round corners. Each panel includes a shell molded from plastic resin, and has a hollow interior which can be filled with water (or other ballast).

21 Claims, 10 Drawing Sheets

(56) References Cited

U.S. PATENT DOCUMENTS

| | | | | |
|---|---|---|---|---|
| 5,988,934 | A | 11/1999 | Wasserstrom | |
| 6,428,237 | B1 * | 8/2002 | Duckett | E01F 15/086 256/13.1 |
| 6,517,442 | B1 | 2/2003 | Post | |
| 6,669,402 | B1 | 12/2003 | Davis et al. | |
| 6,957,546 | B1 | 10/2005 | Farley et al. | |
| 7,351,002 | B2 * | 4/2008 | Yodock, III | E01F 15/083 404/6 |
| 7,849,653 | B2 | 12/2010 | Guertin | |
| 8,540,456 | B2 * | 9/2013 | Marshall | B65D 90/24 405/107 |
| 8,622,648 | B2 * | 1/2014 | Mustafa | B25B 5/101 404/6 |
| 9,095,946 | B2 * | 8/2015 | Kotula | B25J 15/0061 |
| 9,821,216 | B2 | 11/2017 | Kurtin et al. | |
| 2007/0110517 | A1 * | 5/2007 | Wasserstrom | E01F 15/088 404/6 |
| 2007/0116522 | A1 | 5/2007 | Boudreaux | |
| 2009/0003931 | A1 | 1/2009 | Christensen et al. | |
| 2009/0049785 | A1 | 2/2009 | Guertin | |
| 2010/0111602 | A1 * | 5/2010 | Yodock, III | E01F 15/083 404/6 |
| 2012/0213961 | A1 * | 8/2012 | Graham | A47B 47/0075 428/43 |
| 2013/0105475 | A1 | 5/2013 | Marshall | |

OTHER PUBLICATIONS

International Search Report in related PCT application No. PCT/US2017/014570, dated May 30, 2017.

Written Opinion in related PCT application No. PCT/US2017/014570, dated May 30, 2017.

* cited by examiner

MODULAR BARRIER SYSTEM WITH PANELS HAVING ATTACHED LINKS

BACKGROUND OF THE INVENTION

Field of the Invention

This invention relates to modular barrier systems. For example: a modular system to construct a low wall that defines a playing field, or to create an ice hockey rink.

Description of Related Art

Systems for creating outdoor ice skating, or ice hockey, rinks are known. For example a commercially available system, called "NiceRink", enables a backyard ice rink having a peripheral wall constructed from boards and support brackets, with a waterproof liner placed over the enclosed area and folded upwards and then over the peripheral wall. The liner holds water which is allowed to freeze to form a skating surface.

U.S. Pat. No. 5,669,227 describes "a portable ice skating rink including elongate curb structural members and a liner of flat flexible sheet material. The liner is economically made of sheet plastic for example with a bottom sheet and elongate sleeves around the periphery of the bottom sheet. The curb members, such as 4×4 lumber pieces, are inserted into an open end of each sleeve to form a water retaining structure. The sheet material and seams have resistance to water permeation sufficient to retain a shallow pool of water covering the bottom sheet during freezing in outdoor conditions to form an ice skating surface."

U.S. Pat. No. 6,517,442 describes "an enclosure which has a plurality of utilities such as a portable ice skating rink, a wading pool, a volleyball area, and a garden enclosure. The enclosure has a pair of opposed sidewalls and a pair of opposed end walls. Each of the sidewalls is defined by at least one elongated sidewall member and each of the end walls is defined by at least one elongated end wall member. A plurality of corner members define an enclosed area with the end walls and the sidewalls. The enclosure further has at least one sheet member positioned over the sidewalls, the end walls, and the corner members. The enclosure further has cover members which fit over the elongated sidewall members, the end wall members, and the corner members to hold and protect the at least one sheet member."

U.S. Pat. No. 6,957,546 describes a "portable ice skating rink [which] comprises, in a kit, a plastic sheeting, a protective band for the sheeting, and a number of rigid tubular members, flexible connectors and corrugated clips. To assemble the kit, the tubular members are connected to each other in a closed loop using the flexible connectors inserted in facing ends thereof and with corners of the loop being formed by curving some flexible connectors. The sheeting is then laid over the ground of the area enclosed by the loop while extending outwardly over and past the loop. The protective band is laid over the sheeting opposite the loop and the clips are installed thereat to secure the sheeting to the so formed frame with the clips running continuously all along the frame such as to protect the sheeting. Portions of the frame can be raised to level it and the sheeting can then be pulled."

Modular barrier systems for other applications are also known. For example, U.S. Pat. No. 5,611,641 describes a "portable crowd control barrier for use in sporting or entertainment events [which has] lightweight body members formed of a resiliently deformable material and each defining an interior chamber and having slots formed in end walls thereof to receive wooden studs such that the introduction of liquid into the interior chambers deforms the body members, clamping the walls of the slots against the studs and locking the system in place."

U.S. Pat. No. 5,820,470 describes a "portable modular outdoor playing arena having a plurality of modular floor panels and a plurality of generally vertically oriented modular side panels. The floor panels have a generally smooth flat upper surface and side surfaces that depend therefrom at approximate right angles. The floor panels are adjoined in a closed polygonal configuration to create a playing surface. The side panels surround and abut the floor panels and exert a compressive force on the floor panels to prevent lateral separation of adjacent floor panels. A seal forms a fluid tight connection between adjacent floor panels and at the juncture of the floor panels and the side panels. Each of the floor panels include adjustable legs to support the floor panels on the ground or on a sub-surface. The legs are vertically adjustable to allow for the levelling of the floor panels so that adjacent floor panels can be individually levelled and supported to provide a level playing surface."

U.S. Pat. No. 7,849,653 describes an "anchoring panel for a sport wall system with a front side facing an interior of the sport wall system, a back side, a flange extending from and rigidly fixed to the back side, a top side, a bottom side, and a first and second end wall is provided. Each of the first and second end walls include interlocking elements for interlocking with a first or second end of another panel in the sport wall system, the interlocking elements comprising at least a male knob extending towards the bottom side of the anchoring panel and configured to be insertable into a panel recess of another panel in the sport wall system."

U.S. Pat. No. 9,821,216 teaches a portable ice rink that "includes a wall formed of multiple wall members linearly disposed adjacent to one another to form a piecewise continuous wall that encloses a desired area, and also includes a chain of links disposed on the outside of the wall members for reinforcement. The rink may further include a waterproof tarp extending underneath the wall members and folded upwards along the outer side of the wall, with its edge tied to the chain of links. The tarp can contain water which then freezes to form a skating surface. Curved wall members are provided to form a rink with round corners. Each wall member is a discrete unit, made of molded plastic, and having a hollow interior which can be filled with water (or other ballast). Each wall member is designed with stiffening features to maintain the flatness of its inner surface after filling."

SUMMARY

The present invention is directed to a modular barrier system of the type described in U.S. Pat. No. 9,821,216, and includes both improved components and an improved installation method.

An object of the present invention is to provide a high performance, yet low cost, modular barrier system.

A further object of the present invention is to enable outdoor rinks—typically for ice hockey, or ice skating, or street hockey—that are robust and convenient to install.

Additional features and advantages of the invention are set forth in the descriptions that follow, and in part will be apparent from that description, and/or from the appended drawings, or may be learned by practice of the invention.

To achieve these objects, as embodied and broadly described, the present invention provides a modular barrier system which includes a plurality of panels, each of which including a plastic shell that is factory-mated to at least one link.

An embodiment of the present invention provides a method for installing a modular barrier system which includes i) linearly aligning the plastic wall members to form a piecewise continuous wall enclosing a defined area; ii) positioning the factory-attached link(s) of each panel with respect to the corresponding link(s) of its nearest neighbor panels; and iii) connecting each properly positioned link to its nearest neighbors via at least one demountable fastener.

It is to be understood that both the foregoing general description and the following detailed description are exemplary and explanatory; these descriptions are not intended to limit the scope of the invention as further explained below, nor as claimed.

It is also to be understood that embodiments of the present invention teach both straight panels and curved panels, thereby enabling a rink with round corners. To be concise, we explicitly discuss straight panels; curved panels are analogous, and are therefore deemed not to require additional drawings and related text.

DETAILED DESCRIPTION OF PREFERRED EMBODIMENTS

Embodiments of the present invention provide a further improved barrier system of the type taught by U.S. Pat. No. 9,821,216 (herein the '216 patent, which is herein incorporated by reference in its entirety). In particular, each panel (wall member) according to embodiments of the present invention includes at least one factory-attached link. Such panels, accordingly, are sometimes in this patent application referred to as 'unified panels'.

Figure 9:
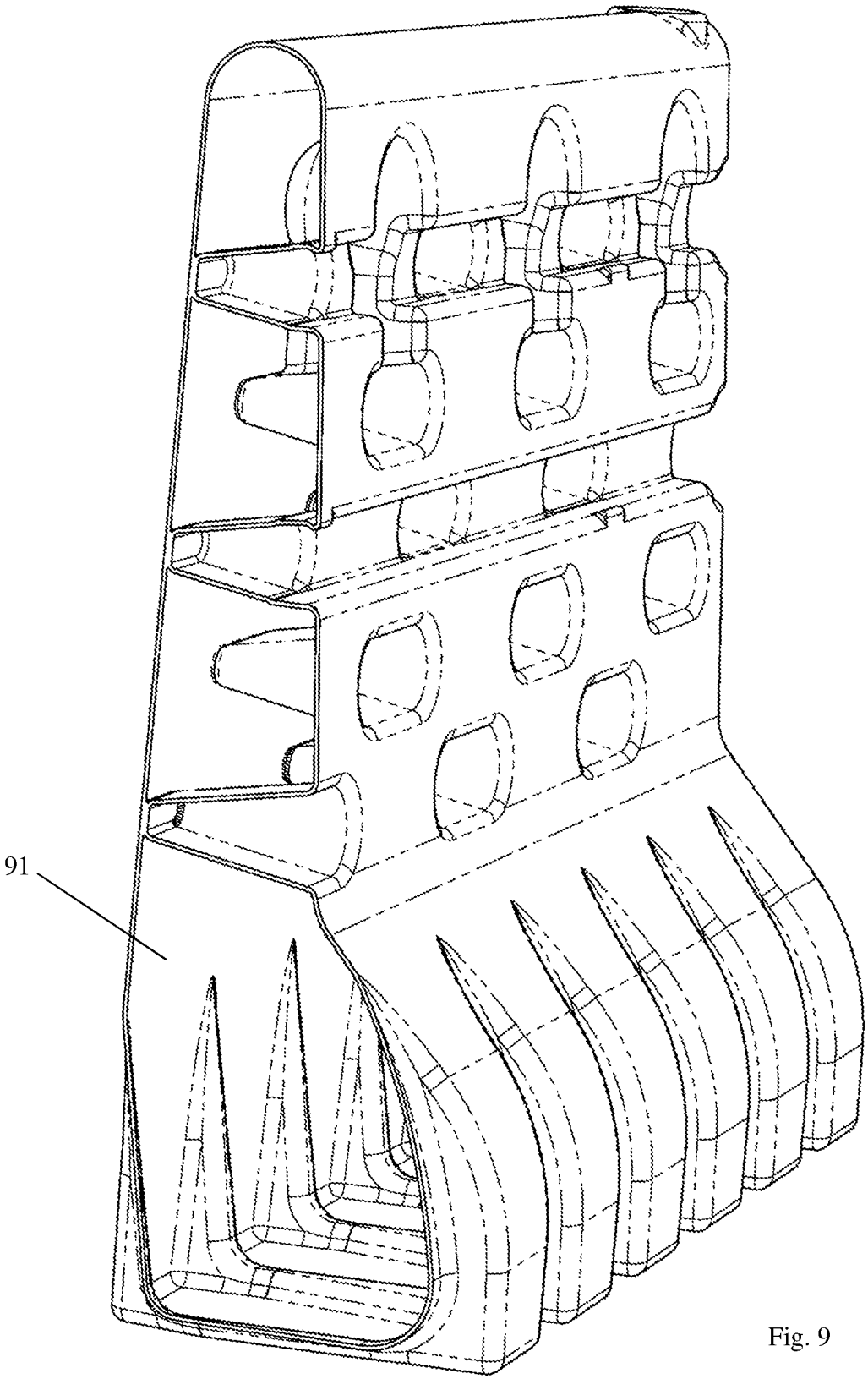
FIG. 9 is a partial cut-away view that illustrates the structure of a panel of the modular barrier system.

As taught in the '216 patent, the shells of the panels are intended to be manufactured from low cost weather-resistant plastic, preferably HDPE and preferably via blow molding. Each shell has a hollow interior space which can be filled with water or a ballast (see FIG. 9, which is adopted from FIG. 10 of the '216 patent; note that this figure does not necessarily illustrate all features of the panel, as it is merely used to illustrate the hollow interior space 91 of the panel). Moreover, since realistic ice hockey play requires predictable flight of the puck, these shells preferably include i) a relatively smooth inner rink wall (with a smooth upper portion), and also ii) rink corners the inner surfaces of which form [except for insignificant local seams] a continuous curve.

Also as taught in the '216 patent, each end of each shells is Vee-shaped in the top view: outward on one end ("male") and inward on the other ("female"). During assembly these Vee-shaped features are nested from one shells to the next, thereby forming a wall.

But nesting does not longitudinally connect one shells to the next, and therefore a rink constructed of shells which are simply nested cannot resist the forces to which it is likely to be subject (for example, in the case of an ice hockey rink, skater impact). Embodiments of the present invention therefore provide belt-like circumferential restraint via the connection, around the entire perimeter of each as-assembled rink, of at least one link per panel to a corresponding link of each nearest neighbor panel. And also provides, for ease of on-site assembly and enhanced robustness, that each link is factory-attached to ("unified" with) a shell.

Figure 1:
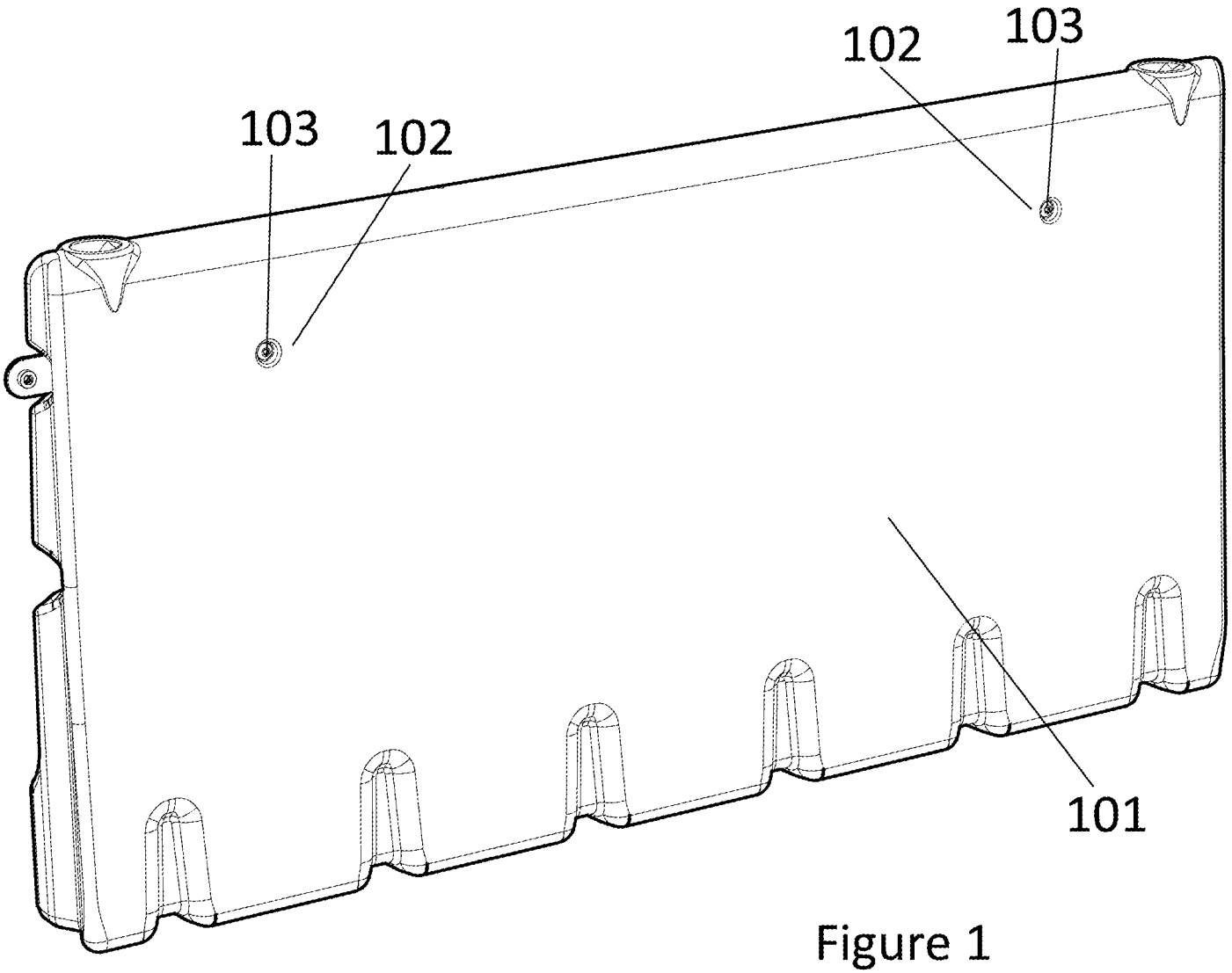
FIG. 1 is a front view (i.e., looking from the inside of a rink made from such panels) of a straight panel according to an embodiment of the present invention; the shell of the panel, and also one end of a straight link factory-attached to the rear surface of the shell, can be seen.

FIG. 1 illustrates the front surface, and female end, of a unified panel in accordance with a preferred embodiment of the present invention. The panel includes a shell 101 which is preferably manufactured via blow molding from low cost plastic resin, typically HDPE. Counterbore 102 is provided, preferably at no less than two distinct locations, each of which is preferably the bottom of a tack-off. A tack-off is the bottom of a deep depression on the back of the shell where the back face material is joined (e.g., welded) to a proximate region of the front face material during molding. As further discussed in connection with FIG. 2, each counterbore includes, near its center, hole 201. This hole cannot be seen in FIG. 1 because it is hidden by screw head 103.

Figure 2:
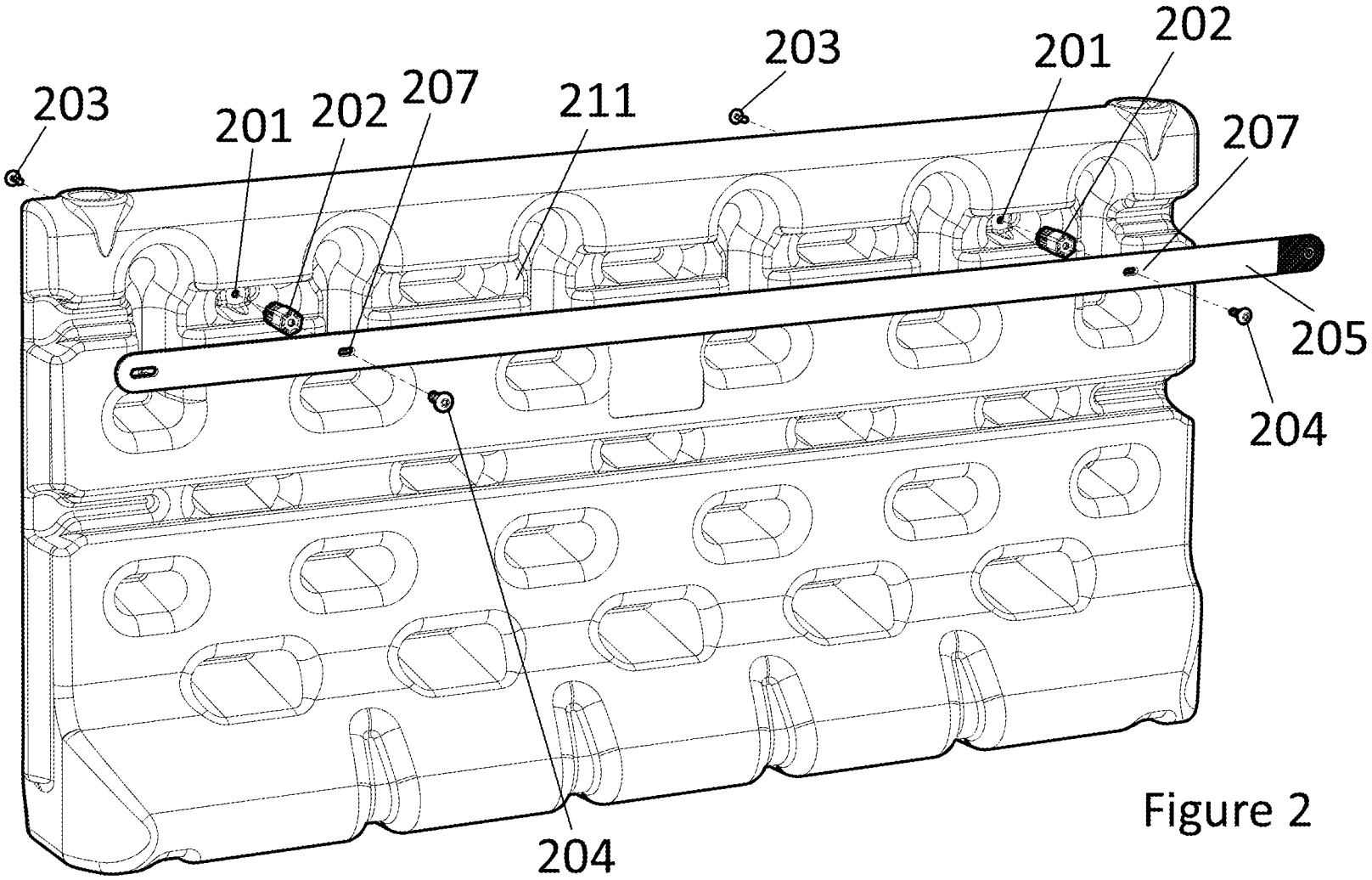
FIG. 2 is a rear view of the panel shown in FIG. 1; this view illustrates, according to an embodiment of the present invention, the attaching of a link.

FIG. 2 illustrates the rear surface of the unified panel shown in FIG. 1. Screws 203, preferably of the thread-forming type, each correspond to screw heads 103. In preparation for link installation a spacer 202 (preferably molded of thermoplastic such as HDPE) is placed against each hole 201 in the corresponding deep depression, and screw 203 is inserted through hole 201 and rotationally driven into the bore of spacer 202.

Preferably the back side of the shell has one or more horizontal grooves 211, and the link 205 is disposed in one of the grooves, and protrudes out of one or both side surfaces of the shell.

To complete "unification" link 205 is placed against spacers 202, and screws 204—preferably also of the thread-forming type—are placed through slots 207 (of which, for each link, no less than two are preferably provided) and driven into the free end of each spacer.

Figure 3:
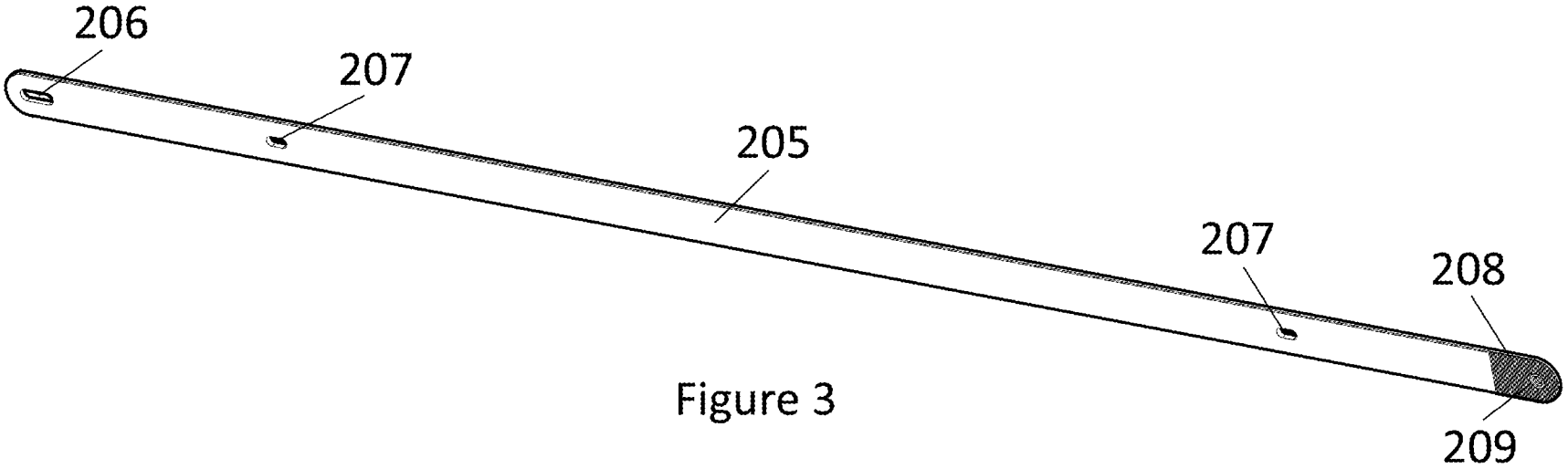
FIG. 3 illustrates a straight link according to a preferred embodiment of the present invention.

FIG. 3 shows a preferred embodiment of a straight link. Links are preferably made of metal; for example, mild steel; if so, it is also preferred to provide a rust-mitigation coating such as galvanization. Slot 206 is utilized during rink assembly. On the back surface of each link at one end (left end in FIG. 3), and therefore hidden from view in this figure, is an array of teeth corresponding to an array of teeth 208 shown at the other end (right end in FIG. 3) of the link. In other words, the array of teeth at each of the two ends of the link face opposite directions. Hole 209 is preferably backed by a press-in nut 210, also hidden from view in this figure, but may—for example—alternatively itself be threaded.

FIG. 3 also shows slots 207 which, as previously described, clear the shank of screw 204. These slots are preferably sufficiently elongated to allow each link to be properly located with respect to its companion panel despite inevitable manufacturing variation in panel dimensions.

Figure 4:
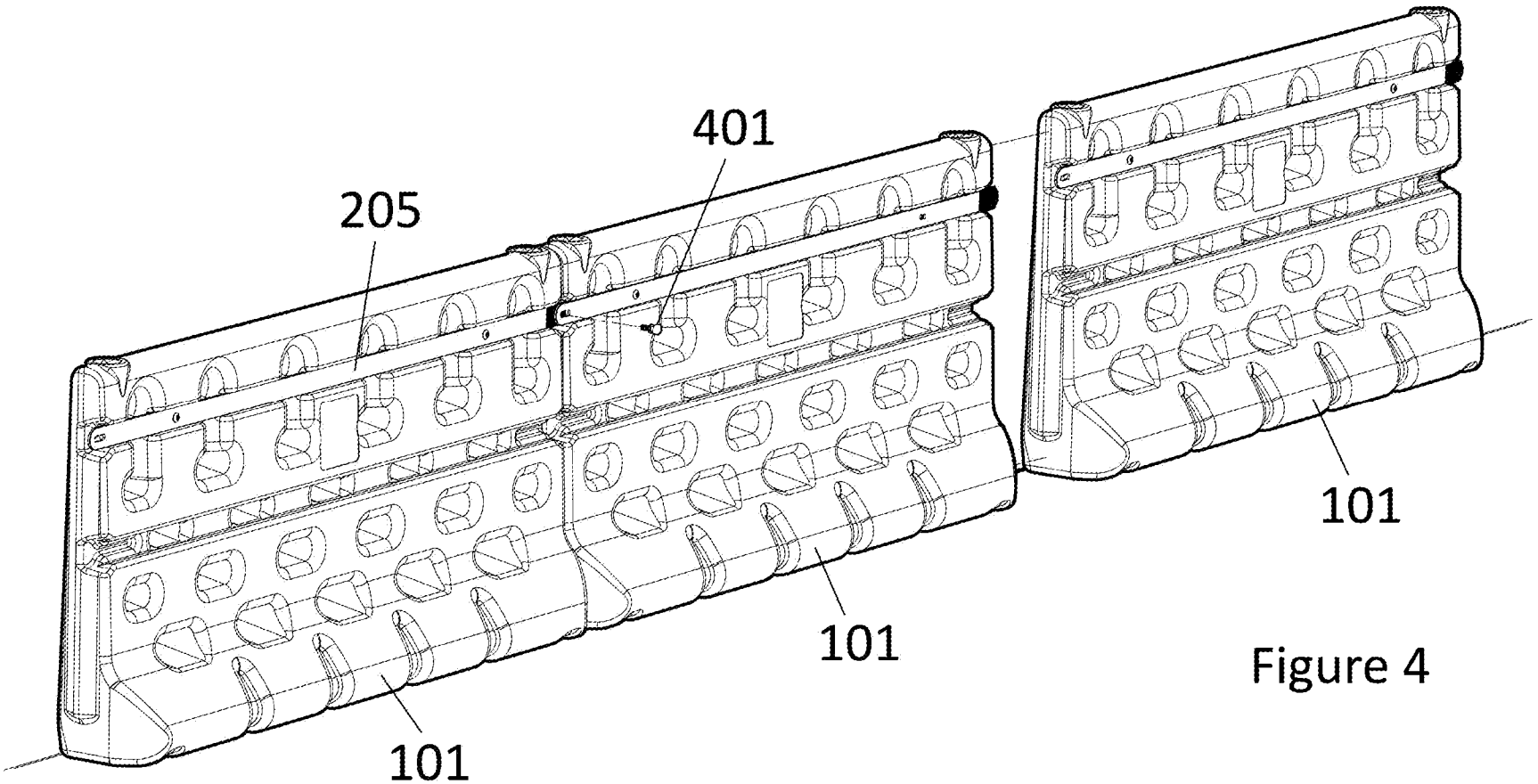
FIG. 4 illustrates three straight panels in the process of being assembled, and connected one to another, according to an embodiment of the present invention.
Figure 5:
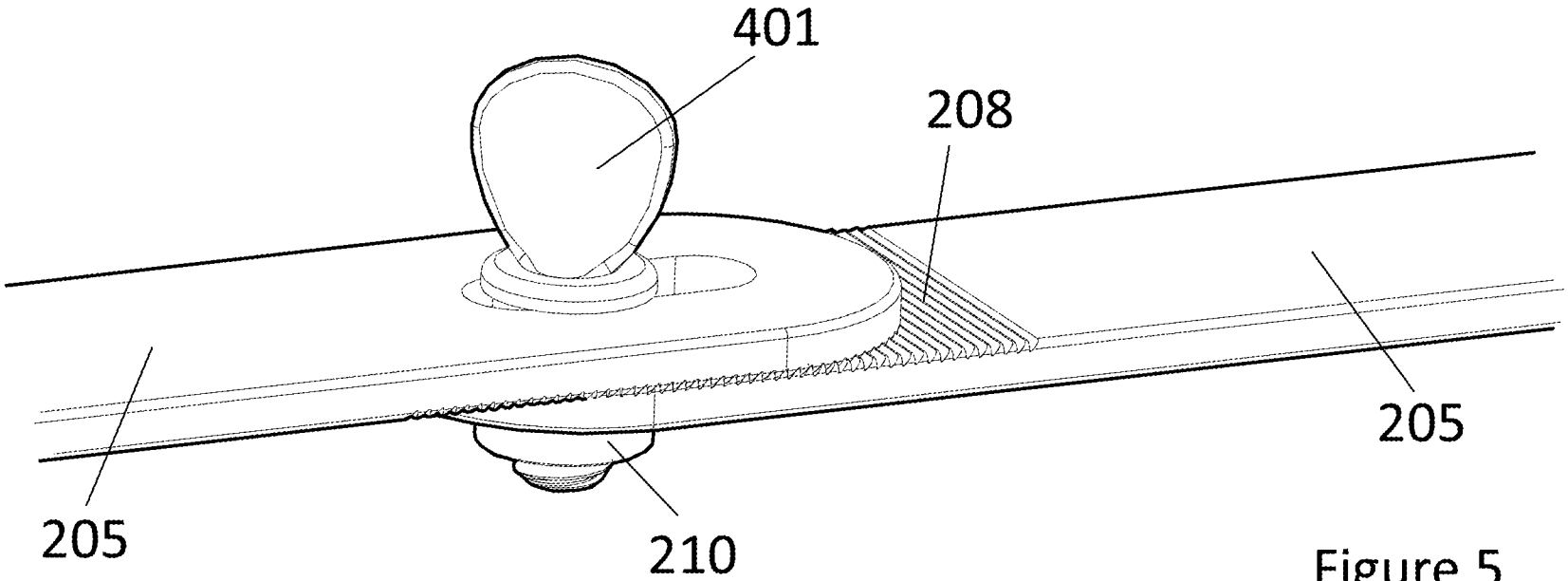
FIG. 5 illustrates the ends of two neighboring straight links, each according to a preferred embodiment of the present invention, connected one to the next.

FIG. 4 illustrates three straight panels in the process of being assembled, and connected one to another, according to an embodiment of the present invention. Thumb screw 401 connects each link to its nearest neighbor. As further seen in FIG. 5, the array of mating teeth 208 on each end of every link enables—during rink assembly—each panel to be tightly nested with its neighbor and then become correspondingly robustly connected via thumbscrew 401 and press-in nut 210. In an alternate preferred embodiment, teeth 208 are omitted and thumbscrew 401 is replaced by, for example, a hex head screw preferably capable of tightly clamping the end of a link to its neighbor. In the illustrated embodiment, the links 205 are longer than the length of the shell 101, which allows for overlapping of neighboring links for the purpose of connecting them together. Each link protrudes past one or both ends of the shell to form the overlap with the neighboring links.

Figure 6:
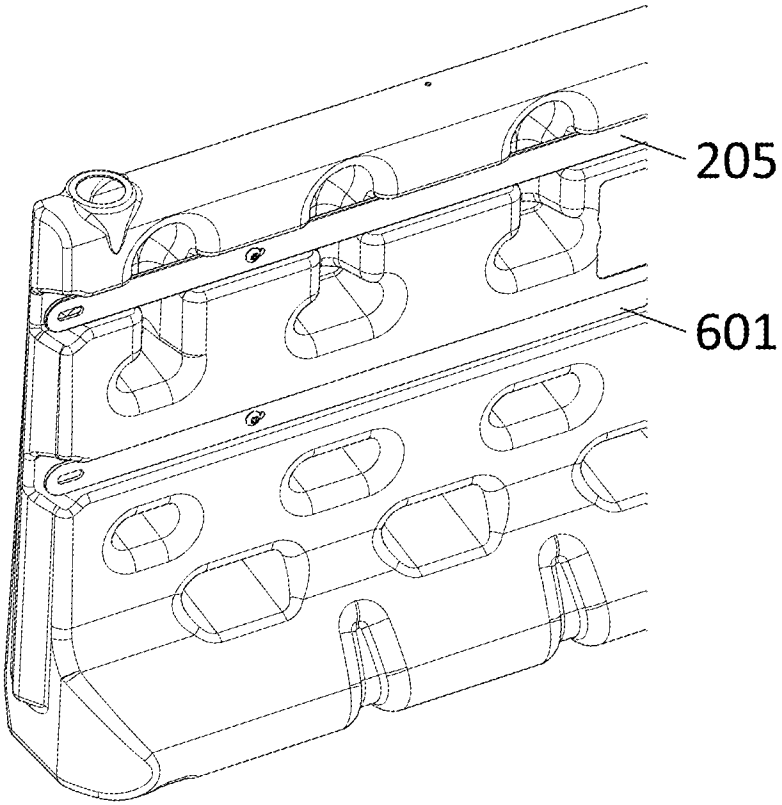
FIG. 6 illustrates the ends of two neighboring straight panels, each according to a second preferred embodiment of the present invention, and each having two factory-attached links.
Figure 6:
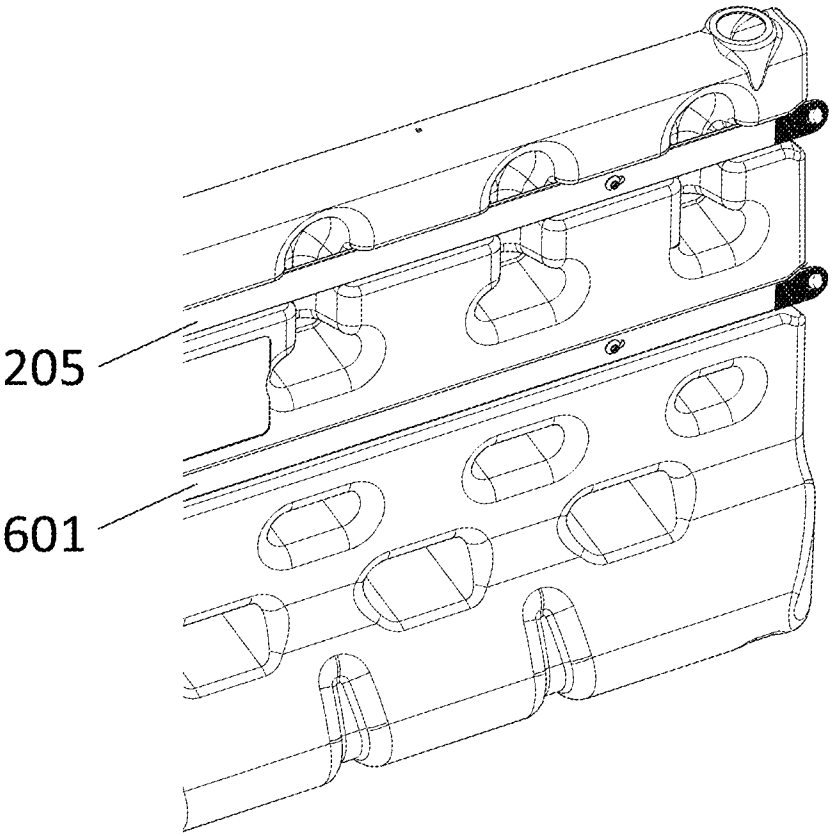

FIG. 6 illustrates a second preferred embodiment. In this second embodiment each panel includes a second link 601. Details of second link attachment preferably correspond with those described above in the context of first link attachment, except that (as shown) it is preferred that the second link be located lower on the shell than the first.

With respect to the first and second preferred embodiments described above, the reader is to understand that the location of each link, and of the attachment points for each link, are merely illustrative. This means that some embodiments of the present invention allow for placing the upper link either higher, or lower, than illustrated. And also for placing the lower link either higher, or lower, than illustrated. Moreover, for example, some embodiments of the invention also allow for placing the attachment point of each link closer to each end of every panel.

Figure 7:
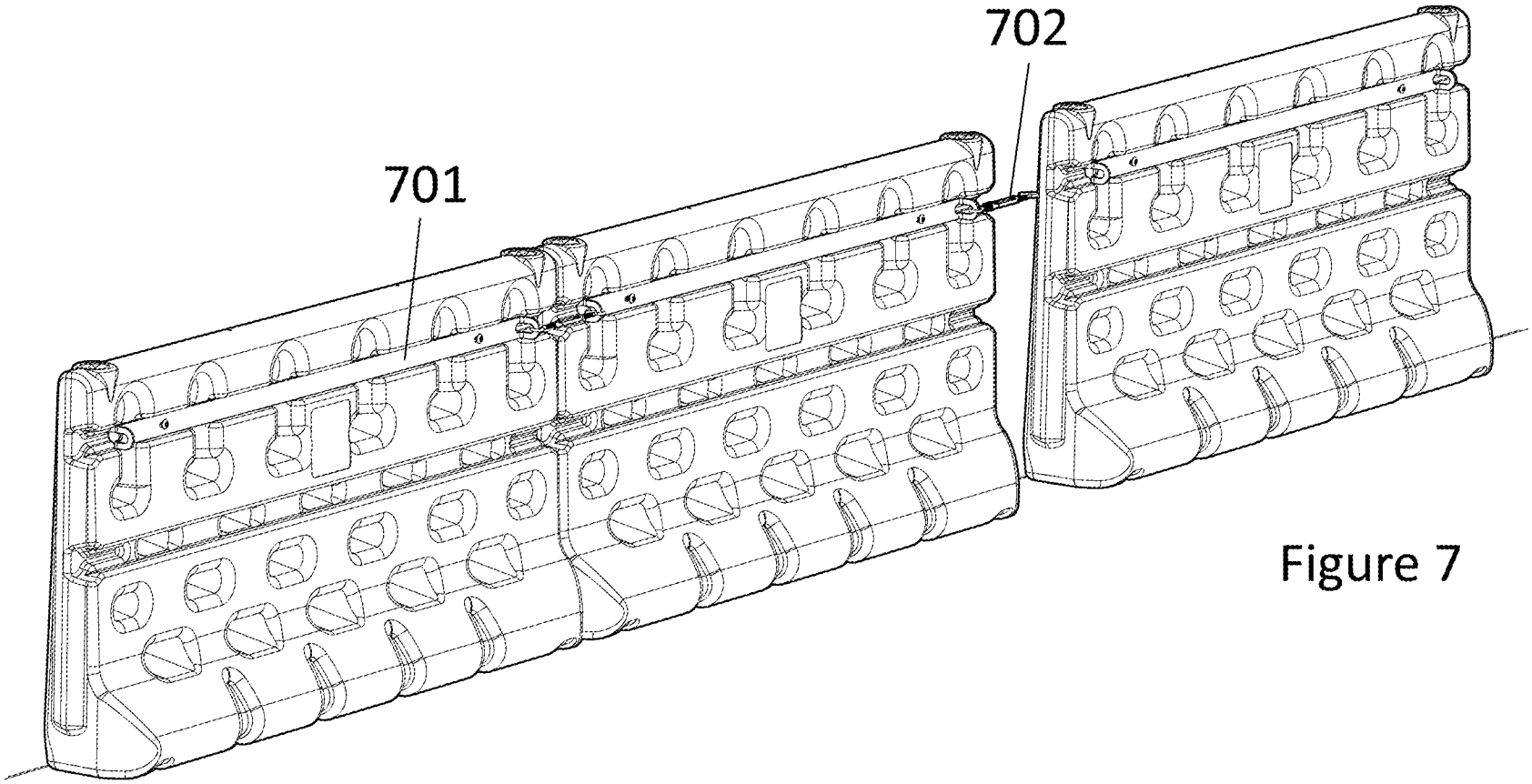
FIG. 7 illustrates three straight panels, each according to a third preferred embodiment of the present invention.

FIG. 7 shows a third preferred embodiment. Here, as illustrated, the links 701 have a somewhat different end configuration, thereby enabling pairwise inter-panel connection via turnbuckle 702. Each end of the link 701 in this embodiment is fitted with a threaded rod, one bearing clockwise threads and the other bearing counter-clockwise threads, thereby allowing a turnbuckle to be formed when these rod are screwed into a threaded tube or similar connecting piece. A fourth preferred embodiment replaces the turnbuckle of FIG. 7 with a rachet-type tightening connection, preferably lever-actuated and further preferably with back motion inhibited by a pawl (which pawl can be disabled to allow for rink disassembly). An advantage of panel connection via turnbuckle—or alternatively via ratchet-tightening connections—is that neighboring panels can be both i) drawn together and ii) robustly attached one to the next, in a single operation (as opposed to first requiring 'snugging up', and then tightening of a thumb screw, as discussed in some detail earlier above).

Figure 8:
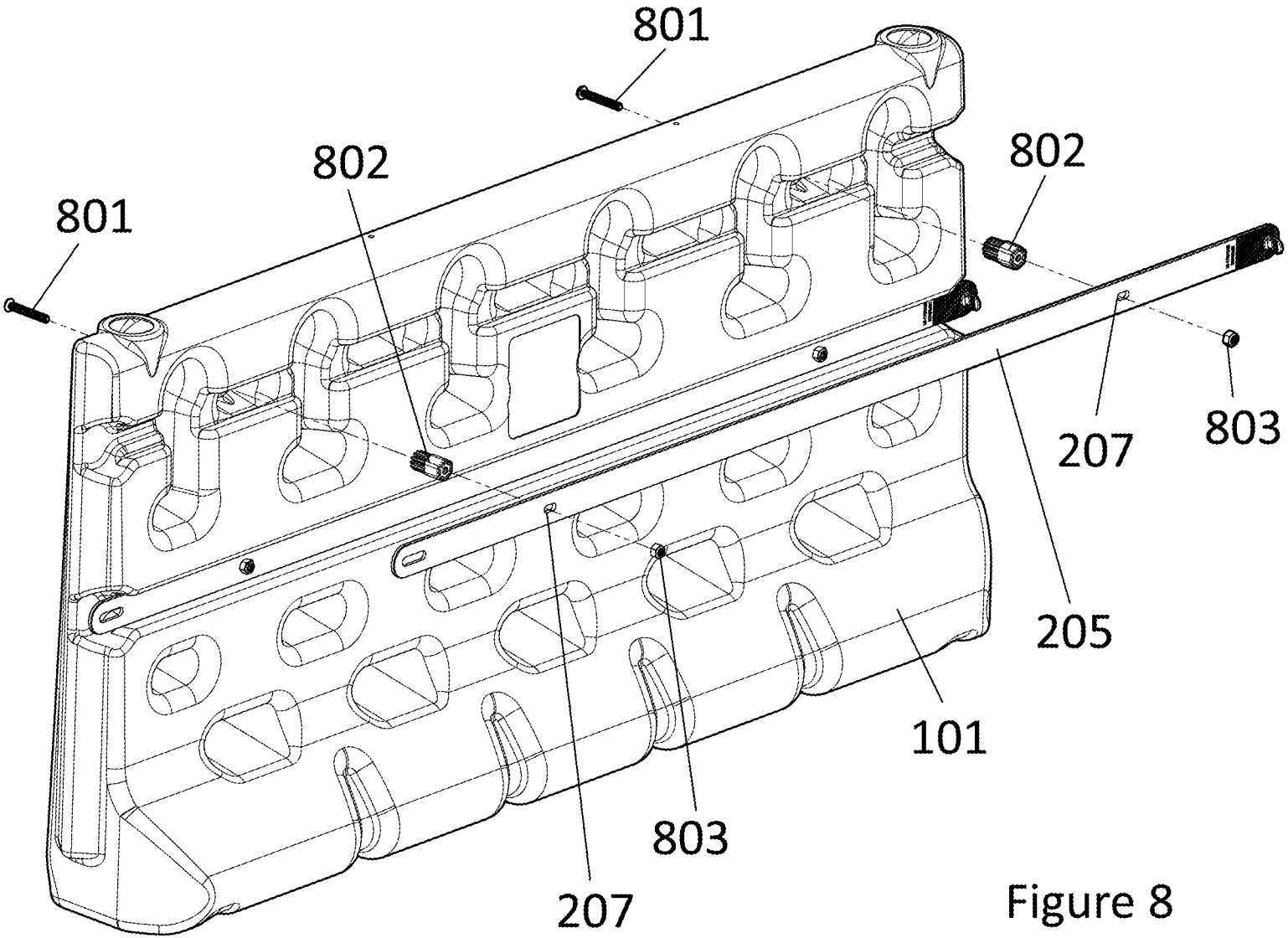
FIG. 8 illustrates a structure for affixing the link to the shell according to an alternative embodiment of the present invention.

FIG. 8 illustrates an alternate preferred embodiment for link-to-panel unification. In this alternate thread-forming screws 203 are replaced by longer machine screws 801; spacers 202 are replaced by spacers 802, which include a through bore; and thread-forming screws 204 are replaced by nuts 803 which mate with screws 801. Unification is thereby achieved with only one screw per link attachment location. Yet another alternate preferred embodiment for unification replaces spacers 202 with standoff features stamped into each link.

Figure 10:
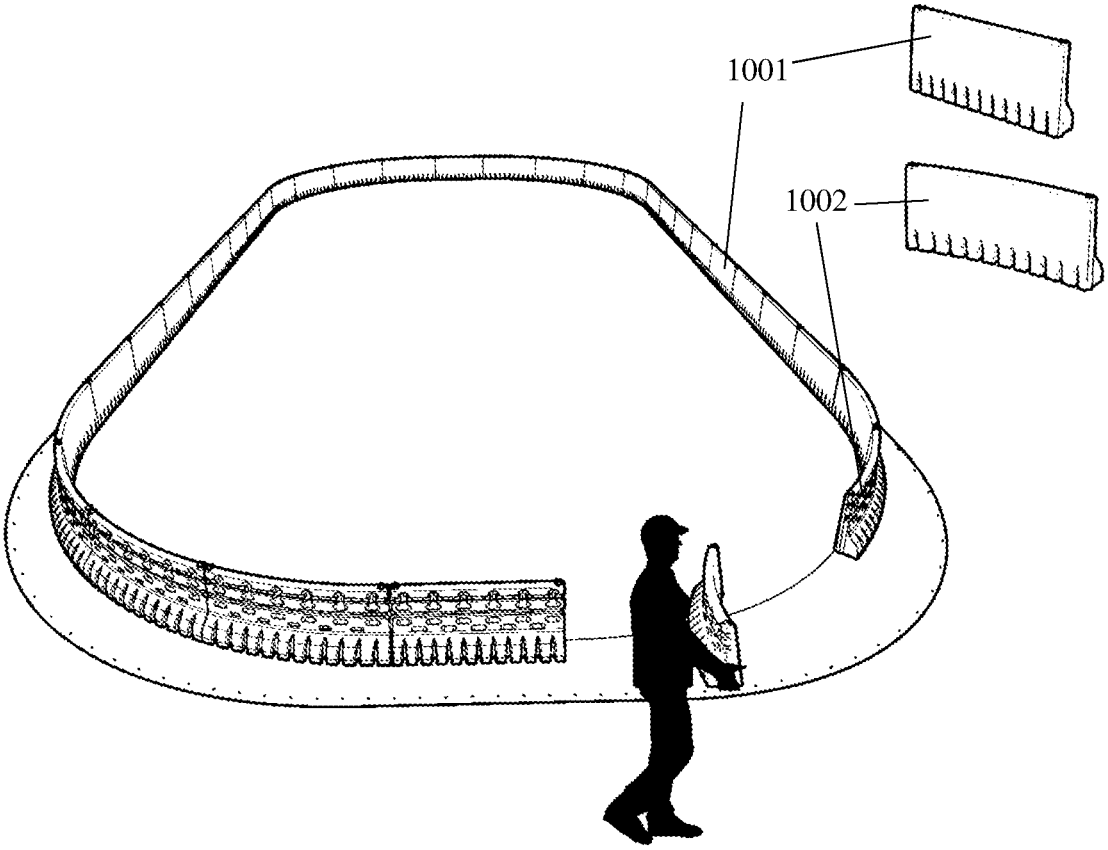
FIG. 10 illustrates a modular barrier system according to an embodiment of the present invention.
Figure 11:
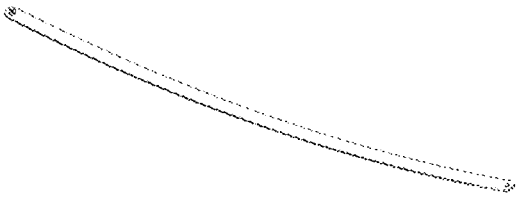
FIG. 11 illustrates a single curved link of the embodiment.

As mentioned earlier, embodiments of the present invention teach both straight panels and curved panels, thereby enabling a rink with round corners. This is illustrated in FIG. 10, which is adopted from FIG. 2 of the '216 patent, showing straight panels 1001 and curved panels 1002. Correspondingly, curved links are provided (see FIG. 11, which is adopted from FIG. 11 of the '216 patent). Note that FIGS. 10 and 11 do not illustrate all features of the panel or the link; they are merely used to illustrate the curved shape of these components.

As to the present invention, it will be apparent to those skilled in the art that various modifications and variations can be made to the modular barrier system, its components, and related installation method, without departing from the spirit or scope of the invention. Thus it is intended that the present invention cover modifications and variations that come within the scope of the appended claims and their equivalents.

What is claimed is:

1. A panel for forming a modular barrier system, comprising:

a shell enclosing a hollow interior space, wherein the shell is formed of a plastic by molding; and a link disposed against a back of the shell and affixed thereto, the link extending horizontally across the shell and protruding past at least one end of the shell, the link having two ends each including a connection structure configured for connecting to a connection structure of a link of another panel, wherein the shell has at least one through hole that extends from a front to the back of the shell, the link has at least one through slot, and wherein as to at least one such through slot the link is affixed to the shell by an affixing assembly that passes through both the through hole and the through slot, the affixing assembly including at least one screw.

2. The panel of claim 1, wherein the shell includes one or more horizontal grooves on the back, and wherein the link is disposed in one of the one or more horizontal grooves.

3. The panel of claim 1, wherein the back of the shell has a plurality of depressions, each depression terminating in a tack-off joined to the front of the shell, wherein at least one of the tack-offs includes the through hole of the shell, and wherein the affixing assembly includes either one screw that passes through both the through hole of the shell and the through slot of the link or two screws that respectively pass through the through hole of the shell and the through slot of the link.

4. The panel of claim 3, further comprising at least one spacer disposed in the depression corresponding to the through hole, and wherein either the one screw extends through the spacer or the two screws each extend into the spacer.

5. The panel of claim 4, wherein the two screws include a first screw passing through the corresponding through hole of the shell and driven into the spacer, and a second screw passing through the corresponding through slot of the link and driven into the spacer.

6. The panel of claim 4, wherein the one screw extends through the corresponding through hole of the shell, the spacer, and the corresponding through slot of the link, and is engaged by a nut.

7. The panel of claim 3, wherein the through hole has a counterbore on the front of the shell, and wherein one of the one more screws has a screwhead disposed inside the counterbore.

8. The panel of claim 1, wherein the connection structure on each of the two ends of the link is a part of a turnbuckle.

9. The panel of claim 1, further comprising a second link disposed against the back of the shell and affixed to the shell, the second link extending horizontally across the shell and protruding past at least one end of the shell, the link having two ends each including a connection structure configured for connecting to a connection structure of a link of another panel.

10. A panel for forming a modular barrier system, comprising:

a shell enclosing a hollow interior space, wherein the shell is formed of a plastic by molding; and a link disposed against a back of the shell and affixed thereto, the link extending horizontally across the shell and protruding past at least one end of the shell, the link having two ends each including a connection structure configured for connecting to a connection structure of a link of another panel, wherein the connection structure on each of the two ends of the link includes an array of teeth, the arrays of teeth at the two ends of the link facing opposite directions.

11. A modular barrier system comprising:

a plurality of panels, each panel including:

a shell enclosing a hollow interior space, wherein the shell is formed of a plastic by molding; and a link disposed against a back of the shell and affixed to the shell, the link extending horizontally across the shell, wherein the shell has at least one through hole that extends from a front to the back of the shell, the link has at least one through slot, and wherein as to at least one such through slot the link is affixed to the shell by an affixing assembly that passes through both the through hole and the through slot, the affixing assembly including at least one screw; and a plurality of connectors, each connector connecting an end of the link of one panel with an end of the link of an adjacent panel.

12. The modular barrier system of claim 11, wherein the plurality of panels include straight panels and curved panels, and the plurality of links include straight links and curved links, and wherein the curved panels form curved corners of the wall.

13. The modular barrier system of claim 11, wherein in each panel, the shell includes one or more horizontal grooves on the back, and the link is disposed in one of the one or more horizontal grooves.

14. The modular barrier system of claim 11, wherein in each panel, the back of the shell has a plurality of depressions, each depression terminating in a tack-off joined to the front of the shell, wherein at least one of the tack-offs includes the through hole of the shell, and wherein the affixing assembly includes either one screw that passes through both the through hole of the shell and the through slot of the link or two screws that respectively pass through the through hole of the shell and the through slot of the link.

15. The modular barrier system of claim 14, wherein each panel further comprises at least one spacer disposed in the depression corresponding to the through hole, and wherein either the one screw extends through the spacer or the two screws both extend into the spacer.

16. The modular barrier system of claim 15, wherein in each panel, the two screws include a first screw passing through the corresponding through hole of the shell and driven into the spacer, and a second screw passing through the corresponding through slot of the link and driven into the spacer.

17. The modular barrier system of claim 15, wherein in each panel, the one screw extends through the corresponding through hole of the shell, the spacer, and the corresponding through slot of the link, and is engaged by a nut.

18. The modular barrier system of claim 14, wherein the through hole has a counterbore on the front of the shell, and wherein one of the one or more screws has a screwhead disposed inside the counterbore.

19. The modular barrier system of claim 11, wherein the connector is a turnbuckle.

20. The modular barrier system of claim 11, wherein each panel further comprises a second link disposed against the back of the shell and affixed to the shell, the second link extending horizontally across the shell and protruding past at least one end of the shell, the link having two ends each including a connection structure configured for connecting to a connection structure of a link of another panel.

21. A modular barrier system, comprising:

a plurality of panels, each panel including:

a shell enclosing a hollow interior space, wherein the shell is formed of a plastic by molding; and a link disposed against a back of the shell and affixed to the shell, the link extending horizontally across the shell; and a plurality of connectors, each connector connecting an end of the link of one panel with an end of the link of an adjacent panel, wherein in each panel, each of the two ends of the link includes an array of teeth, the arrays of teeth at the two ends of the link facing opposite directions.

* * * * *